US009777917B2

(12) United States Patent
Johansen

(10) Patent No.: US 9,777,917 B2
(45) Date of Patent: Oct. 3, 2017

(54) LIGHTING FIXTURE AND A METHOD OF DE-HUMIDIFYING A WATER-PROOF LED LIGHTING FIXTURE

(71) Applicant: SGM LIGHT A/S, Aarhus V (DK)

(72) Inventor: Peter Johansen, Aarhus (DK)

(73) Assignee: SGM LIGHT A/S, Aarhus (DK)

( * ) Notice: Subject to any disclaimer, the term of this patent is extended or adjusted under 35 U.S.C. 154(b) by 0 days.

(21) Appl. No.: 14/902,252

(22) PCT Filed: Jun. 20, 2014

(86) PCT No.: PCT/IB2014/062475
§ 371 (c)(1),
(2) Date: Dec. 30, 2015

(87) PCT Pub. No.: WO2015/001443
PCT Pub. Date: Jan. 8, 2015

(65) Prior Publication Data

US 2016/0369997 A1 Dec. 22, 2016

(30) Foreign Application Priority Data

Jul. 5, 2013 (DK) ..... 2013 00410

(51) Int. Cl.

| | |
|---|---|
| ***F21V 31/03*** | (2006.01) |
| *F21W 131/406* | (2006.01) |
| *F21Y 115/10* | (2016.01) |
| *F21V 21/30* | (2006.01) |
| *F21W 131/107* | (2006.01) |

(52) U.S. Cl.
CPC ..... *F21V 31/03* (2013.01); *F21V 21/30* (2013.01); *F21W 2131/107* (2013.01); *F21W 2131/406* (2013.01); *F21Y 2115/10* (2016.08)

(58) Field of Classification Search
CPC ..... F21V 31/03; F21V 2115/10; F21V 23/30; F21V 2131/107; F21V 2131/406
See application file for complete search history.

(56) References Cited

U.S. PATENT DOCUMENTS

| | | | | |
|---|---|---|---|---|
| 2009/0122570 | A1 | 5/2009 | Hsu et al. | |
| 2011/0222305 | A1 | 9/2011 | Huang | |
| 2015/0070927 | A1* | 3/2015 | Kurahashi | F21S 48/335 362/546 |

FOREIGN PATENT DOCUMENTS

| | | | |
|---|---|---|---|
| EP | 0401495 | A1 | 12/1990 |
| EP | 0859188 | A1 | 8/1998 |
| EP | 2014972 | A1 | 1/2009 |
| JP | 2001023425 | A | 1/2001 |
| JP | 2010153963 | A | 7/2010 |
| WO | 2013175538 | A1 | 11/2013 |

* cited by examiner

*Primary Examiner* — David V Bruce
(74) *Attorney, Agent, or Firm* — Pearne & Gordon LLP

(57) ABSTRACT

A method of removing moisture from a closed environment of inside a LED based lighting fixture, comprises the step of utilizing an electrolysis based dehumidifying device (7, 9) to lower humidity level of inside said closed environment, a current being applied to the electrolysis based dehumidifying device (7, 9) whereby the electrolysis based dehumidifying device (7, 9) draws moisture out of said closed environment, through electrolysis.

10 Claims, 2 Drawing Sheets

8
7
1
3
2
6
4
5
11
9
10

LIGHTING FIXTURE AND A METHOD OF DE-HUMIDIFYING A WATER-PROOF LED LIGHTING FIXTURE

FIELD OF THE INVENTION

The present invention relates to a method of removing moisture from a closed environment of inside a lighting fixture with PCB mounted LEDs. The invention further relates to a LED based lighting fixture provided with a device for removing moisture.

BACKGROUND OF THE INVENTION

In the lighting industry there has for many years been lighting fixtures with a high ingress protection, rated for being used outdoor, for either permanent fixed installations, or for short-term use. With conventional light sources there is traditionally a high amount of heat coming from the discharge light source, and this causes the fixture to be at a constantly high working-temperature, so this usually does not cause a big problem with moisture in the air in the lamp, as the constant high temperature causes the moisture to evaporate into the air, and stay that way, with the high temperature inside the fixture.

In LED based lighting fixtures, things are a bit different. LED based lighting fixtures have a much lower working temperature, and also this temperature is not constant. This is due to the nature of not having a constantly running discharge light source, and the higher efficacy of LED light sources compared to normal light sources.

This causes the temperature of a LED based lighting fixture to vary a lot, and this gives condensation problems inside the fixture. The air from when the unit is assembled is trapped inside the unit, and causes the moisture inside the lighting fixture to sometimes be evaporated into the air, when the temperature is high, and when the temperature inside the fixture falls then the water will condense into dew which sits on PCBs and other parts inside the lamp.

This method describes a way of using an electrolysis-type dehumidifier to prevent this from happening.

DESCRIPTION OF THE INVENTION

An object of the invention is to improve known lighting fixtures, particularly LED based lighting fixtures.

A further object is to allow moisture level inside a lighting fixture to be kept below a critical threshold, so that operation of the lighting fixture is not negatively affected by moisture.

In a first aspect of the invention, there is provided a method of removing moisture from a closed environment of inside a LED based lighting fixture, comprising the step of utilizing an electrolysis based dehumidifying device to lower humidity level of inside said closed environment, a current being applied to the electrolysis based dehumidifying device whereby the electrolysis based dehumidifying device draws moisture out of said closed environment, through electrolysis.

In a second aspect of the invention, there is provided a lighting fixture, comprising a light source including at least one LED, the lighting fixture further comprising an electrolysis based dehumidifying device for lowering humidity level in a closed environment defined inside the lighting fixture.

Owing to the first and second aspects of the invention, moisture inside the lighting fixture can be reduced to a non-critical value, thereby avoiding dew condensation on the internal components of the lighting fixture.

Furthermore, the electrolysis based dehumidifying device has a quite compact structure, and can be successfully used even in lighting fixtures in which the available free spaces are extremely narrow.

Finally, the electrolysis based dehumidifying device is noiseless and works with very low energy consumption.

The invention will be better understood and carried out with reference to the attached drawings, which show an exemplificative and non limitative embodiment thereof, in which.

The invention consists of a method of utilizing an electrolysis based dehumidifying device to lower the humidity level of inside a LED based lighting fixture, by applying a current to the device which draws moisture out of the device it is mounted inside, through electrolysis.

When direct current is applied to the porous electrode attached to a solid polymer electrolyte membrane, moisture at the anode side (dehumidifying side) is separated into hydrogen ions (H+) and oxygen. The hydrogen ions pass through the solid polymer electrolyte membrane to the cathode side (moisture discharge side). The hydrogen ions react with oxygen in the air on the cathode side to form water molecules (gas) and are then discharged.

Combining this technology with water-tight lighting LED based fixtures makes it possible to dramatically reduce the level of humidity inside the fixture over a period of time.

Figure 3:
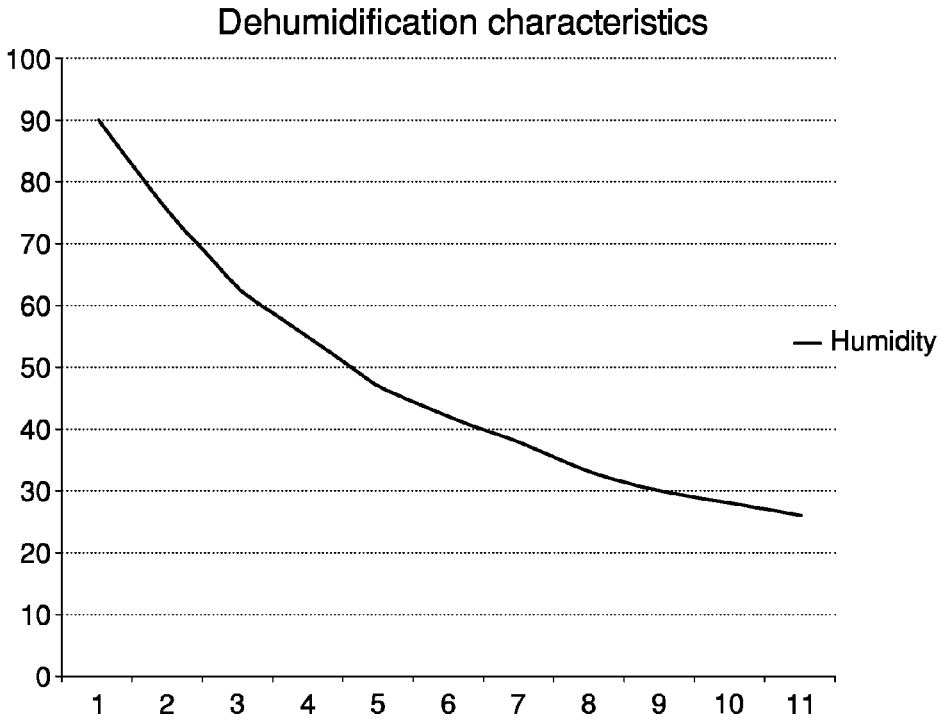
FIG. 3 is a diagram showing the dehumidification characteristics over a period of 10 hours.

The diagram of FIG. 3 shows the dehumidification characteristics over a period of 10 hours.

This graph clearly shows that the level of humidity can be reduced significantly, and thereby preventing the problems that often occurs in these kinds of applications. With the dehumidifier mounted, the fixture will be protected against dew condensation.

The advantage of using this method for dehumidifying a fixture is that it uses a very low amount of energy to run, it is completely noiseless and the method can be used in a very tight space, as the device is very small.

The invention applies to fixtures with one or more PCB mounted LEDs and the application of a electrolysis dehumidifier in these kinds of fixtures.

Figure 1:
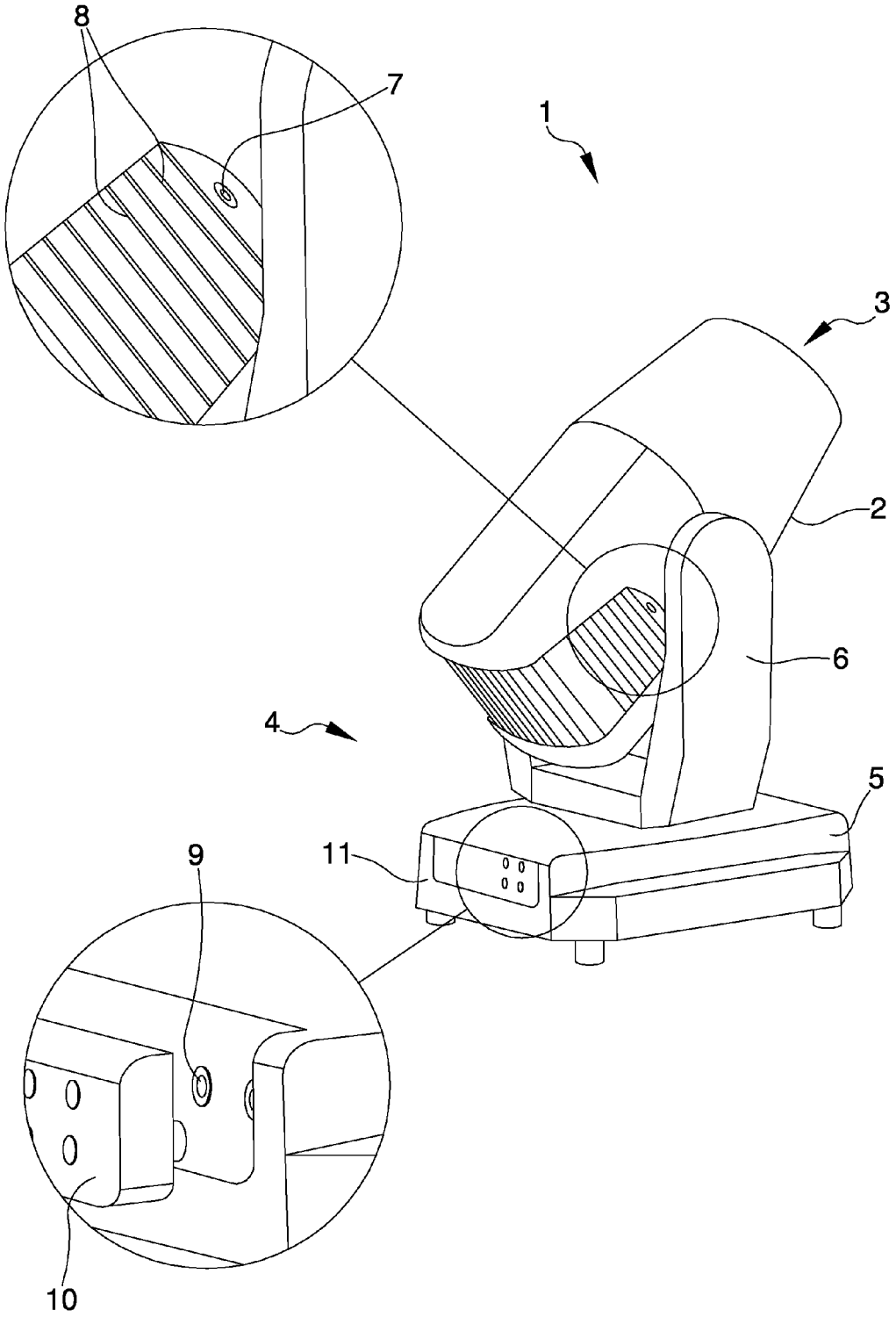
FIG. 1 is a perspective view of a lighting fixture comprising an electrolysis based dehumidifying device.

It applies for fixtures with a high ingress protection rating of 55 or above. FIG. 1 shows a lighting device or lighting fixture 1 that can be used to illuminate a stage during a public event such as a music concert, a sport meeting, a convention or the like. The lighting fixture 1 can also be used to illuminate a building, for example a historical building, a public building or a hotel, or more generally to illuminate any other environment, such as a space in which a monument, a fountain or other is located.

The lighting fixture 1 is specially adapted for outdoor use. In particular, the lighting fixture 1 may have an IP code of 55 or more. The IP (International Protection or Ingress Protection) code is an international code which classifies and rates the degree of protection provided against intrusion, dust, accidental contact and water by mechanical casings and electrical enclosures.

A device having an IP code of 55 is a device which is dust protected and is protected against water jets. More in detail, ingress of dust is not entirely prevented, but dust does not enter in sufficient quantity to interfere with satisfactory operation of the device. Complete protection against contact is ensured. Furthermore, water projected by a nozzle (6.3 mm) against an enclosure of the device from any direction shall have no harmful effects.

The lighting device 1 comprises a light source for emitting a light beam in a direction. The light source may be a light emission diode (LED). More than one light source can be used in a single lighting device, as is the case of a lighting device comprising a plurality of LEDs.

The light source is housed inside a closed environment defined in a housing 2, for example made of polymeric material. The housing 2 is provided with an opening 3 from which the light beam emitted by the light source may exit. The opening 3 may be provided with lenses or other optics in order to control the light beam.

The housing 2 is supported by a supporting arrangement 4 that, in the example shown, can be rested on a horizontal surface. In an alternative embodiment, which is not shown, the supporting arrangement 4 may be so configured as to allow the lighting fixture 1 to be suspended from a fly system of the stage.

The supporting arrangement 4 may comprise a base 5 which supports a movable supporting element 6. In the embodiment shown in FIG. 1, the movable supporting element 6 is shaped as a yoke. However, other shapes of the movable supporting element 6 are also possible.

Inside the base 5, a closed environment is defined which houses a control unit for controlling operation of the lighting fixture 1. The user can interact with the control unit through a plurality of push-buttons, knobs and other control devices provided on the base 5.

The supporting element 6 can be rotated about a vertical axis relative to the base 5. Furthermore, the housing 2 can be rotated about a horizontal axis relative to the supporting element 6. Orientation of the light source can accordingly be changed, so as to allow different points of the stage to be illuminated.

As shown in the enlarged detail of FIG. 1, a dehumidifying device 7 can be provided on the housing 2, so as to remove moisture from inside the closed environment in which the light source is contained. The dehumidifying device 7 can be arranged on a side wall of the housing 2, near a plurality of slots 8 acting as air vents on the housing 2.

A further dehumidifying device 9 can be provided on the base 5, particularly behind a panel 10 removably attached to a back wall 11 of the base 5.

Figure 2:
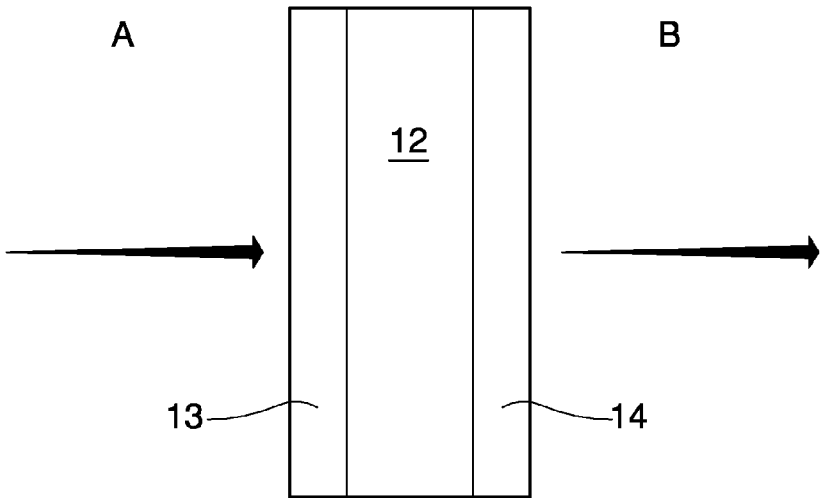
FIG. 2 is a schematic view of an electrolysis based dehumidifying device.

Both the dehumidifying devices 7, 9 are electrolysis based devices and work as will be explained below with reference to FIG. 2.

Each dehumidifying device 7, 9 comprises a solid state polymeric ionic membrane 12 interposed between a first porous electrode 13 acting as an anode and a second porous electrode 14 acting as a cathode.

The dehumidifying device 7, 9 is installed such that the first porous electrode 13 faces an environment A to be dehumidified, i.e. the inside of the lighting fixture 1. The second porous electrode 14 faces an environment B in which moisture can be discharged, i.e. the outside of the lighting fixture 1.

When a voltage is applied to the dehumidifying device 7, 9, the water molecules in environment A to be dehumidified dissociate into hydrogen ions and oxygen. The hydrogen ions pass through the membrane 12 to reach the environment B, in which they combine with oxygen in the air, thereby originating water vapour that can be discharged.

Thus, operation of the dehumidifying devices 7, 9 is based on an electrolysis process.

The dehumidifying devices 7, 9 are permanently connected to a power supply of the lighting fixture 1, so that the dehumidifying devices 7, 9 are active when power is applied to the lighting fixture 1.

The dehumidifying devices 7, 9 allow moisture to be removed respectively from the inside of the housing 2 and from the inside of the base 5.

FIG. 3 shows how moisture decreases over a period of 10 hours.

As shown, moisture can be removed in a quick and efficient way. Dew formation on components of the lighting fixture 1 is therefore avoided.

The invention claimed is:

1. A lighting fixture, comprising a light source including at least one LED, the lighting fixture further comprising an electrolysis based dehumidifying device for lowering humidity level in a closed environment defined inside the lighting fixture, wherein the electrolysis based dehumidifying device comprises a solid state polymeric ionic membrane interposed between a first porous electrode acting as an anode and a second porous electrode acting as a cathode, and wherein the first porous electrode faces said closed environment to remove moisture therefrom, the second porous electrode facing a space outside of the lighting fixture to discharge in said space moisture extracted from said closed environment, wherein the light source is housed inside the closed environment defined in a housing and wherein the electrolysis based dehumidifying device is configured to remove moisture from inside the closed environment in which the light source is directly contained.

2. A lighting fixture according to claim 1, and further comprising a base which contains a control unit for controlling the light source.

3. A lighting fixture according to claim 2, wherein the electrolysis based dehumidifying device is associated to the housing, said closed environment being defined inside the housing.

4. A lighting fixture according to claim 3, wherein the dehumidifying device is arranged on a side wall of the housing, near a plurality of slots acting as air vents on the housing.

5. A lighting fixture according to claim 2, wherein the electrolysis based dehumidifying device is associated to the base, said closed environment being defined inside the base.

6. A lighting fixture according to claim 1, and having an Ingress Protection code of 55 or more.

7. A lighting fixture according to claim 1, wherein the electrolysis based dehumidifying device is provided on the housing and wherein the lighting fixture further comprises a base and wherein a further electrolysis based dehumidifying is provided on the base.

8. A lighting fixture according to claim 1, wherein the lighting fixture comprises a movable supporting element.

9. A lighting fixture according to claim 8, wherein the lighting fixture further comprises a base and wherein the supporting element is rotatable about a vertical axis relative to the base and the housing is rotatable about a horizontal axis relative to the supporting element.

10. A lighting fixture according to claim 1, wherein the light source including the at least one LED is in direct contact with the closed environment, and the electrolysis dehumidifying device is configured to remove moisture directly from inside the closed environment.

* * * * *